US009167854B2

(12) United States Patent
Levian

(10) Patent No.: US 9,167,854 B2
(45) Date of Patent: Oct. 27, 2015

(54) POSTURE-IMPROVING GARMENT

(71) Applicant: Michael Levian, Beverly Hills, CA (US)

(72) Inventor: Michael Levian, Beverly Hills, CA (US)

( * ) Notice: Subject to any disclaimer, the term of this patent is extended or adjusted under 35 U.S.C. 154(b) by 165 days.

(21) Appl. No.: 13/673,794

(22) Filed: Nov. 9, 2012

(65) Prior Publication Data

US 2013/0232659 A1 Sep. 12, 2013

Related U.S. Application Data

(60) Provisional application No. 61/609,568, filed on Mar. 12, 2012.

(51) Int. Cl.
*A41B 9/16* (2006.01)
*A41B 1/08* (2006.01)
*A41B 9/06* (2006.01)

(52) U.S. Cl.
CPC ... *A41B 1/08* (2013.01); *A41B 9/06* (2013.01); *A41B 9/16* (2013.01)

(58) Field of Classification Search
CPC . A41D 1/00; A41D 13/1245; A41D 2400/38; A61F 5/0101; A61F 5/02; A61F 5/026; A41B 9/16
USPC ..... 2/69, 113, 120, 308, 310, 311, 316, 2/326, 329, 330; 602/5, 19, 20; 473/266, 473/269, 276, 277
See application file for complete search history.

(56) References Cited

U.S. PATENT DOCUMENTS

| | | | | |
|---|---|---|---|---|
| 4,018,226 | A | 4/1977 | Korgemets | |
| 4,273,328 | A | 6/1981 | Ozbey et al. | |
| 5,299,323 | A | 4/1994 | Schaefer et al. | |
| 6,315,747 | B1 * | 11/2001 | Toole | 602/19 |
| 6,440,094 | B1 | 8/2002 | Maas | |
| 7,134,969 | B2 | 11/2006 | Citron et al. | |
| 7,395,557 | B1 | 7/2008 | Ledyard | |
| 7,871,388 | B2 | 1/2011 | Brown | |
| 7,914,473 | B2 * | 3/2011 | Josey | 602/19 |
| 7,930,769 | B2 | 4/2011 | Stern | |
| 2004/0194190 | A1 | 10/2004 | Gathings, Jr. | |
| 2004/0244097 | A1 * | 12/2004 | Kassai et al. | 2/310 |
| 2005/0070830 | A1 * | 3/2005 | Schultz | 602/19 |

* cited by examiner

*Primary Examiner* — Andrew W Collins
(74) *Attorney, Agent, or Firm* — Robert A. Seldon

(57) ABSTRACT

A garment for improving the wearer's posture provides cords that, when secured in place, exert a slight pressure against the wearer's shoulders each time he/she starts to slouch, serving as a reminder to be more erect. The garment had a horizontal channel that is located around the body of the user, preferably just below the breast area, that accommodates a first cord. The garment further includes vertically-extending channels that extend upward from the horizontal channel and over the shoulders of the user. A cord extending along each vertical channel engages the cord in the horizontal channel such that the horizontal cord anchors the vertical cord(s) when the cords are pulled sufficiently, lightly engage the front of the wearer's shoulders. Once the cords are secured in place, the wearer will feel a slight pressure against his/her shoulders each time he/she starts to slouch, serving as a reminder to be more erect.

7 Claims, 4 Drawing Sheets

POSTURE-IMPROVING GARMENT

FIELD OF THE INVENTION

The invention relates to a posture-improving garment that can be worn as an undershirt.

BACKGROUND OF THE INVENTION

A number of methods have been proposed to improve posture by means of a garment having built-in mechanisms of various sorts, examples of which are found in U.S. Pat. No. 7,395,557, U.S. Pat. No. 7,134,969, U.S. Pat. No. 7,871,388, U.S. Pat. No. 6,440,094 and U.S. Pat. No. 4,273,328. Each of these references is hereby incorporated by reference.

Garments having channels through which one or more cords can pass to adjust the shape of a garment are described and illustrated in, for example, U.S. Pat. No. 4,018,226, U.S. Pat. No. 5,299,323, U.S. Pat. No. 7,930,769, and published U.S. Patent Application 2004/0194190. Each of these references is hereby incorporated by reference.

All the foregoing methods and configurations involve the incorporation of bands or straps that substantially increase the cost and/or bulk of the garment, or do not suggest or teaching method useful in improving the posture of the user.

BRIEF SUMMARY OF THE INVENTION

The present invention provides a structure and method for enabling one wearing a garment constructed in accordance with the invention to improve his or her posture simply by pulling on cords that, when secured in place, serve to exert a slight pressure against the wearer's shoulders each time he/she starts to slouch, serving as a reminder to be more erect. The user's body will soon naturally acquire a better posture owing to the constant reminder provided by the garment each time slouching begins owing to proprioception (the body's sense of the relative position of its neighboring parts).

The garment carries a first generally horizontally-extending cord that is positioned to extend about the user's body of a user in the region of the user's rib cage. The fit of the first cord is sufficiently adjustable to enable the user's body to resist upward movement of the garment.

The garment also carries a pair of generally vertically-extending cord segments extending upwardly along the front of the garment from the first cord (or a region of the garment adjacent the first cord), on respective sides of the garment's centerline. The vertically-extending cord segments pass over respective shoulders of the garment, and extend down the back of the garment and to a position at which they are accessible to a person wearing the garment (the "user").

The generally vertically-extending cord segments are substantially secured against upward movement at the front of the garment by the generally horizontally-extending cord, so that an appropriate pulling and securing of the cord segments in the rear of the garment will subsequently cause pressure to be exerted against the user's shoulders as the user slouches, serving as a reminder to the user to be more erect. The user's body will soon naturally acquire a better posture owing to the constant reminder provided by the garment each time slouching begins owing to proprioception (the body's sense of the relative position of its neighboring parts).

These and further details of the invention will be apparent to those of ordinary skill in the art from reading a description of the preferred embodiment of the invention described below, of which the drawing forms a part.

DETAILED DESCRIPTION OF THE PREFERRED EMBODIMENT OF THE INVENTION

Referring to the Figures, a garment 10 constructed in accordance with the invention is illustrated in the form of a tank top or sleeveless undershirt. This is merely a preferred embodiment of a garment, and it will be clear that any other type of garment that cover the chest area of a user may be employed as well without departing from the scope or spirit of the invention.

When referencing the garment and its elements, the terms "left" and "right" will be used to respectively denote the left and right side of the garment. Thus, when looking at the front of the garment in FIG. 1, the "right" will be on the reader's left. When looking at the rear of the garment in FIG. 2, the "right" will be on the reader's right.

Figure 1:
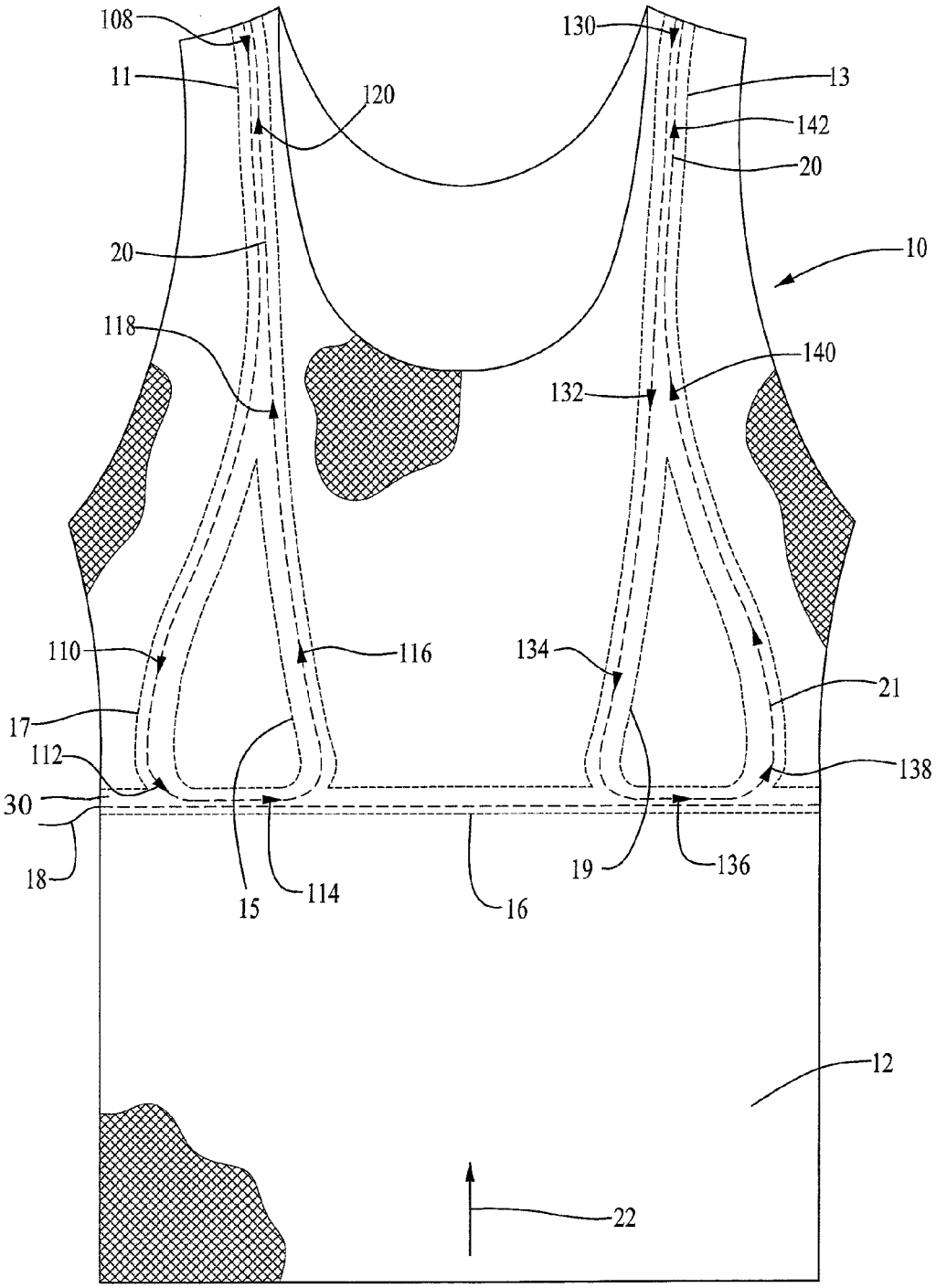
FIG. 1 is a front elevation view of a garment constructed in accordance with the invention.
Figure 2:
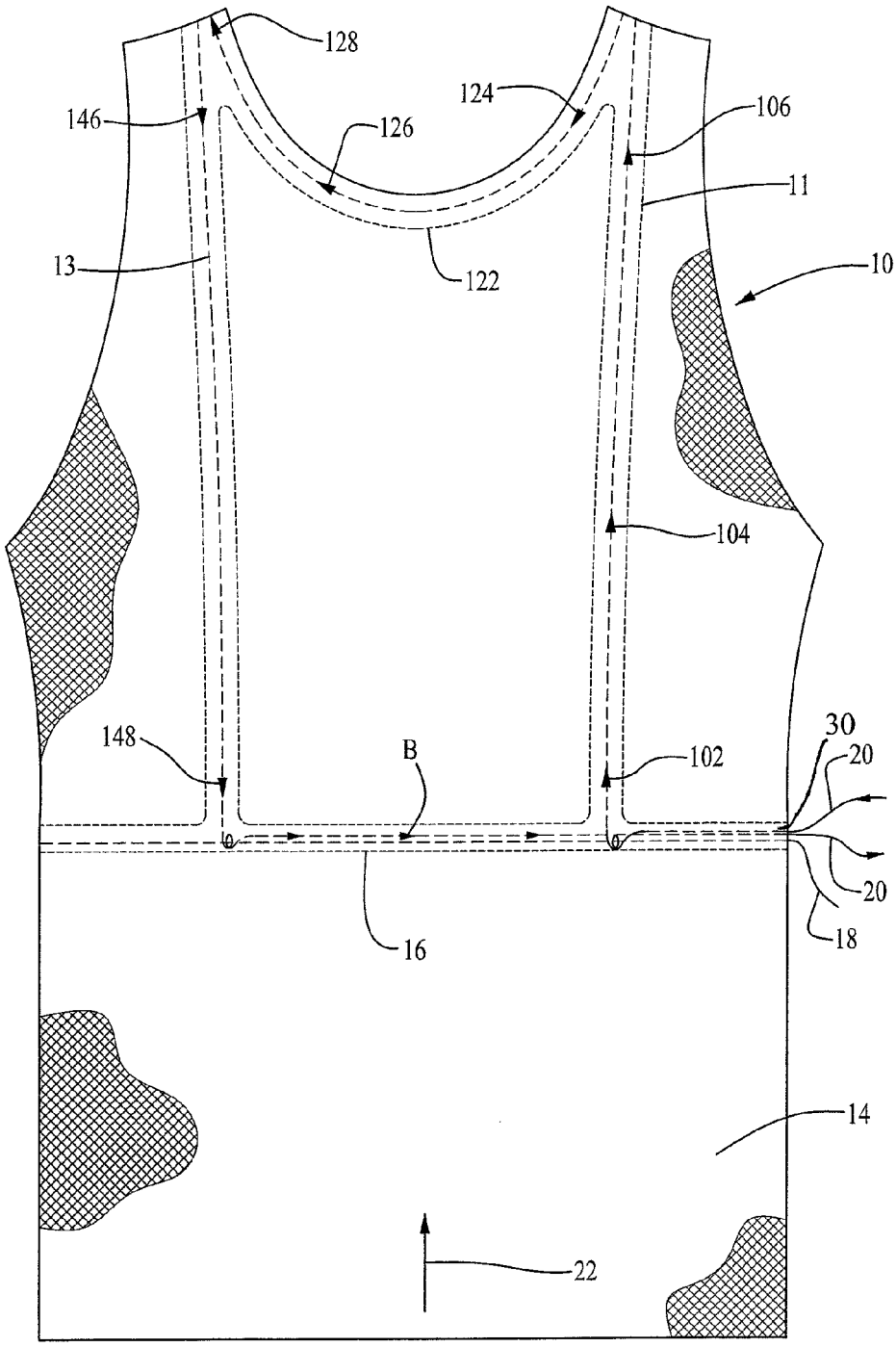
FIG. 2 is a rear elevation view of the garment of FIG. 1.
Figure 3:
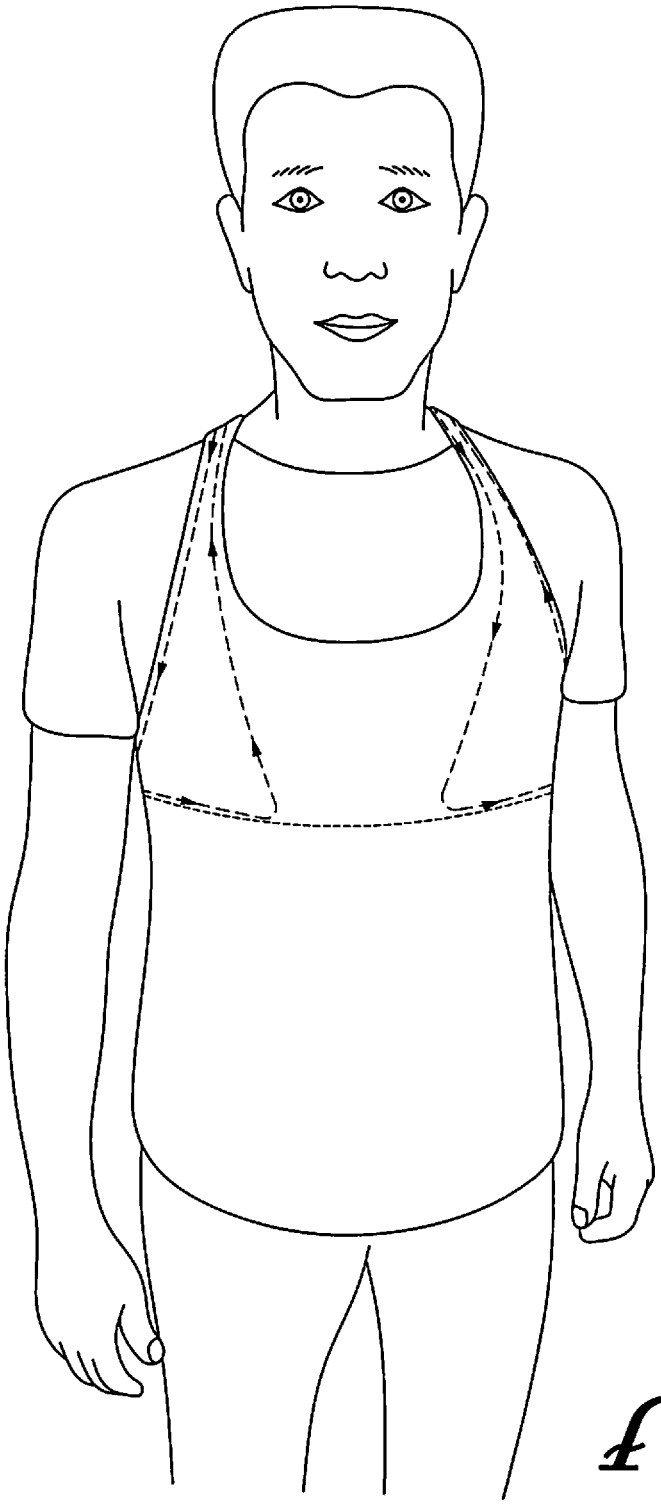
FIG. 3 is a front elevation view of a person wearing the garment of FIGS. 1 and 2.
Figure 4:
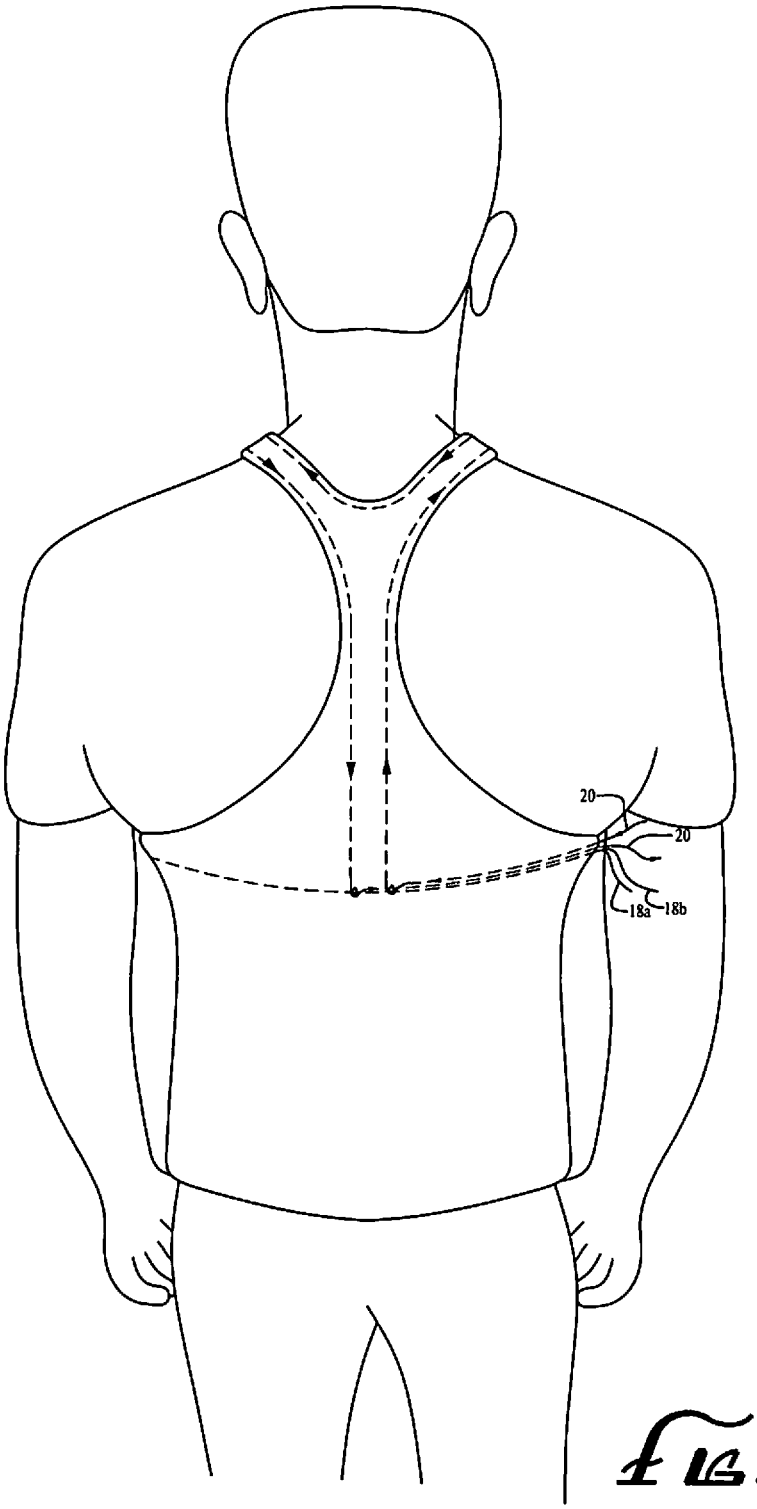
FIG. 4 is a rear elevation view of a person wearing the garment of FIGS. 1 and 2.

FIG. 1 is a front elevation view of the presently preferred garment, illustrating the front 12 of the garment 10, while FIG. 2 is a rear elevation view of the garment of FIG. 1. A generally horizontally-extending channel 16 is formed within, or on the interior or exterior surface of, the garment and is positioned to extend around the garment just below the breast area of the user, whether male or female. The channel 16, hereinafter conveniently referred to as the "horizontal channel" for the sake of simplicity, can alternatively be positioned to extend around another region of the user's chest or around the garment just under the user's chest or rib cage, but these alternatives are not preferred.

As with other channels to be described, the horizontal channel 16 is illustrated in broken lines for the purpose of visual clarity. It should be understood that the channels preferably lie under a layer of material that touches (or is closest to) the user's body, or the channel may be formed on that layer of material. In another variation, the channels may be formed on the garment's exterior.

Each channel can be formed by overlapping the garment material to form an elongated loop that will serve as the channel, and then sewing (or otherwise affixing) the overlapped layers together along a line where the layers interface to define the channel. Alternatively, one or more channels can each be formed by a strip of material affixed along its outer edges to the interior or exterior surface of the garment, as the case might be; e.g., by glue or by sewing, to form the channel between the strip and the garment.

It will be apparent to those of ordinary skill in the art that the horizontal channel 16 need not circumscribe the garment by a full 360°, but only sufficiently to yield the desired effect as hereinafter described. However, it is preferable to circumscribe the garment for substantially 360°.

As illustrated in FIG. 1, the preferred horizontal channel 16 communicates with generally vertically-extending right and left channels 11, 13 that extend upwardly from the horizontal channel 16 and over respective shoulders of the garment. At least a portion of the preferred vertically-extending right and left channels 11, 13 (hereinafter referred to as the "vertical channels" for convenience) are flexible enough to permit the vertical distance between the horizontal channel 16 and top of the garment to be changed for reasons that will become clear.

Looking at the front of the garment 10 in FIG. 1, it may be seen that the preferred right vertical channel 11 includes a loop-shaped segment in the front of the garment, forming two generally vertically-extending arms 15, 17 that are separated by an interjacent segment lying within, and preferably formed by, a section of the horizontal channel 16. Alternatively, the interjacent segment may be a segment that does not lie within the horizontal channel 16, but is instead affixed to it via adjacent channel walls that are (for example) sewn or glued to each other or to interjacent coupling material. Preferably, the channels defined by the vertically-extending arms 15, 17 join as they extend upward from the horizontal channel 16 to form a single channel prior to passing the neckline of the garment. However, the two arms and the channels therein can be maintained without departing from the spirit or scope of the invention.

Similarly, the preferred left vertical channel 13 is also loop-shaped in the front, forming two generally vertically-extending arms 19, 21 separated by an interjacent segment lying within, and preferably formed by, the horizontal channel 16. The interjacent segment can alternatively be affixed to the horizontal channel as described above with respect to the interjacent segment of the vertical channel 11. Preferably, the upward-extending channels defined by the vertically-extending arms 19, 21 join to form a single channel prior to passing the neckline of the garment as they extend from the horizontal channel 16. Again, however, the two arms and channels therein can be maintained without departing from the spirit or scope of the invention.

FIG. 2 is a rear elevation view of the garment of FIG. 1. Turning to FIG. 2, it may be seen that the right and left vertical channels 11, 13 pass over respective shoulders of the garment, extend down the back of the garment and communicate with respective regions of the horizontal channel 16 in the rear of the garment. Preferably, the respective regions are laterally separated and lie generally vertically below respective shoulders of the garment.

As described earlier, any or all of the channels 16, 11, 13, 15, 17, 19 and 21 can be formed by looping and sewing together (or otherwise affixing to each other) garment material to thereby form the channel. Alternatively, one or more channels can each be formed by a strip of material affixed along its outer edges to the surface of the garment, e.g., by glue or by sewing, to form the channel between the strip and the garment. Another alternative simply employs elongated tubular structures affixed to the garment, (e.g., by glue or by sewing) which function as the channels. Yet another alternative is to employ a plurality of loops separated from each other, similar to the belt loops on a pair of pants, to form the channel via the path passing through the plurality of loops. In any case, at least the arms 15, 17, 19, 21 of the vertically directed channels 11, 13 are flexible enough to allow the horizontal channel 16 to be raised in the direction 22 as hereinafter described Cords 18, 20 are disposed through the channels, and emerge from the shirt at 30. As shown in FIGS. 1 and 2, one cord 18 extends around the garment through the horizontal channel 16, with one or both ends emerging from an opening 30 in the shirt preferably located on the side of the shirt below the arm.

As will be described later, this cord is pulled to sufficiently tighten the region of the horizontal channel about the user's body to obtain a desired result. If the garment is configured so that both ends 18*a*, 18*b* of the cord 18 emerge from the opening, both ends are pulled, and then tied or clamped to prevent loosening. If the garment is configured so that only one end of the cord 18 emerges from the opening, the cord 18 within the channel should preferably be of sufficient length to extend at least approximately 270° around the user, with the non-emerging end being affixed or restrained within the horizontal channel so that the pulling of the emerging end does not result on the cord simply being pulled out of the horizontal channel instead of causing a tightening against the user's body.

A second cord 20 is also illustrated as extending from the same opening 30 of the garment as cord 18. As illustrated in FIG. 2, the second cord 20 passes through the opening, loops around the first cord 18 (for reasons described later), and passes upward within the right vertical channel 11 in the back of the garment and over the right shoulder as illustrated by the arrows at 102, 104 and 106. As then shown in FIG. 1, the second cord 20 passes downwardly within the right vertical channel 11 in the front of the shirt as shown by the arrows 108, 110, and into the horizontal channel 16 as shown by the arrow 112.

As shown by the arrow 114, the second cord 20 then extends across the right loop segment that preferably lies within the horizontal channel 16, and up the right vertical channel 11, as shown by arrows 116, 118, 120. The second cord 20 then extends over the right shoulder. Turning to FIG. 2, the second cord 20 then extends and around a neck area channel 122, in the garment's rear, to the left shoulder as illustrated by arrows 124, 126, 128 and passes over the left shoulder of the garment.

As shown in FIG. 1, the second cord 20 then extends down the front of the garment within the left vertical channel 13 (arrows 130, 132, 134) into the left loop segment that preferably lies within the horizontal channel 16 (arrows 136, 138), back up the left vertical channel 11 (arrows 140, 142), over the left shoulder of the garment, and down the left vertical channel in the rear of the garment into the horizontal channel 16 (FIG. 2, arrows 146, 148).

The second cord 20 then loops once around the first cord 18 (for reasons described below) before passing across the rear of the garment through the horizontal channel 16 to the opening 30, where it emerges.

As can be appreciated from FIGS. 1 and 2, the pulling of the ends of the second cord 20 results in the second cord 20 exerting an upward force on the portion of the horizontal channel 16 extending across the front of the garment. If the horizontal channel is not initially located in a position at which the user's body prevents upward movement, the horizontal channel will move upward slightly until its movement is stopped by the user's rib case or breast area which broaden in the upward direction. As previously described, at least a portion of the preferred vertical channels 11, 13 are flexible enough to permit that upward movement.

The aforedescribed looping of the second cord 20 around the first cord 18 in the two places identified above causes the second cord 20 to more directly exert an upward force on the horizontal channel 16 while minimizing lateral slippage of the garment. By looping the second cord 20 around the first cord 18, the first cord offsets a lateral force component which would otherwise cause the garment to be rotated laterally about the user's body when the cord 20 is pulled at the opening 30 in the side of the garment.

In the preferred embodiment, both cords 18 and 20 are pulled at the same time while the person wearing the garment (the "user") assumes a position of good posture. It is accordingly preferred that the cord 18 and cord 20 emerge from the shirt at the same location, but they can emerge of different locations without departing from the scope of the invention.

In use, the user can, for example, stand with his/her back against a wall to help achieve good posture. With the first cord 18 pulled snugly around the user's torso, and the user assuming a position of good posture, the second cord 20 is pulled until there is a lightly snug pressure exerted by the second cord 20 against the front of the user's shoulders. The first cord 18 prevents the garment from simply rising upward as the second cord 20 is pulled. The channel 16 may rise very slightly, but its movement upward is resisted by the widening shape of the user's chest in the upward direction.

Once the cords 18 and 20 are pulled sufficiently, they can be held in place by tying, or they can be retained by use of any of a myriad of fasteners, clamps or other securing devices known in the art or hereinafter devised. Examples of such devices can be found in U.S. Pat. Nos. 3,132,390, 3,965,544, 3,845,575 and 4,112,551. Each of these references is hereby incorporated by reference.

Once the garment is adjusted as described above, the user will feel a slightly greater pressure against the front and top of his/her shoulders each time he/she starts to slouch, serving as a reminder to be more erect. The user's body will soon naturally acquire a better posture owing to the constant reminder provided by the garment each time slouching begins. Owing to proprioception (the body's sense of the relative position of its neighboring parts), wearing the garment for a short time each day will quickly train the body to assume good posture without the use of the garment.

Those of ordinary skill in the art will recognize that the coupling of the cord 20 to the horizontal channel 16 can be accomplished in other ways as well. For example, the cord 20 can be replaced with a pair of cords, each of which extends via a respective vertical channel over a respective shoulder, into a respective loop segment and back up the respective shoulder to and into the rear portion of the horizontal channel. In such case, the neck channel can be eliminated. Accordingly, it will be appreciated that the cord segments located on the left and right sides of the shirt may be segments of the same cord, as in the preferred embodiment, or they may be separate cords as described by this alternative.

In another alternative embodiment, the pair of cord segments can extend via a respective vertical channel over a respective shoulder, to or into a respective portion of the horizontal channel at the front of the garment, where they can be coupled to respective locations of the horizontal channel wall or directly to the horizontal cord, so as to be anchored in the front as they are pulled and secured to subsequently exert the required amount of pressure against the user's shoulders each time he/she slouches. Whether being directly coupled to the vertical cord segments, or being indirectly coupled to them via for example the wall of the horizontal channel, it will be appreciated that the first cord 18 serves as an anchor against which the vertical cord segments are tensioned to create the shoulder-engagement utilized by the garment herein.

Those of ordinary skill in the art will recognize that each emerging end of the cord 20, or each emerging end of the two cords used in lieu of a single cord 20, can emerge from the garment at different locations, but it is preferred that they emerge at the same location for easier and better adjustment.

Those of ordinary skill in the art will also recognize that the cords 18, 20 may emerge from other locations on the shirt than that shown in the figures without departing from the spirit or scope of the invention, and need not necessarily emerge from the same location (although it is preferred that they do so).

With respect to the channels, it may be noted that the channels illustrated and described above are each formed by an elongated loop of material or by a plurality of loops separated from each other, similar to belt loops on a pair of pants. As used herein, the term "channel" shall be understood to include the latter variation, wherein the channel is the path passing through the plurality of loops that have been arranged to accommodate the cord passing therethrough.

It should be understood that other minor changes, substitutions and alterations can be made herein by those of ordinary skill in the art without departing from the spirit and scope of the invention, as will be defined by appended claims. It is accordingly intended that all such changes, substitutions and alterations be included within the scope of the appended claims, and that claims be interpreted as broadly as possible under the Doctrine of Equivalents.

I claim:

1. A garment disposed about a centerline and having a front, a back, a left side and a right side, said garment comprising:

a generally horizontally-extending channel formed in the garment to extend generally horizontally about the body of a user wearing the garment;

a pair of generally vertically-extending channels, each extending over a respective shoulder of the garment-wearing user from the generally horizontal channel in the rear of the garment towards or into the generally horizontal channel in the front of the garment without crossing the centerline of the garment; and cords disposed in the channels in such a way that, when pulled and secured, cause the generally horizontal channel to be secured about the user's body and the generally vertical channels to exert a lightly sensed pressure against the user's shoulders that increases when the user slouches as a reminder to be more erect, at least one end of each cord being accessible to the user for pulling and securing via at least one opening in the garment.

2. The garment of claim 1 wherein the channels are formed by respective strips of material affixed to the interior of the garment.

3. The garment of claim 1 wherein the interiors of the vertical channels lead into the interior of the generally horizontally-extending channel at both the front and the back of the garment.

4. The garment of claim 1 including a first cord disposed within the generally horizontal channel to substantially circumscribe the user's body, and a pair of cord segments distinct from said first cord that extend through a respective one of the generally-vertical channels into the generally horizontal channel at the rear of the garment, said cord segments being coupled to the generally horizontally-extending channel in the front of the garment in such way that said pulling of the cord segments exerts a substantially upward force on the generally horizontally-extending channel at the front of the garment, said cord segments being guided by the first cord within the generally-horizontal channel at the rear of the garment to minimize lateral movement of the garment about the user.

5. The garment of claim 4 wherein the cord segments are part of the same cord extending through both vertical channels.

6. The garment of claim 4 wherein the cord segments are not part of a cord extending through both vertical channels.

7. The garment of claim 1 wherein the generally horizontally-extending channel is positioned on the garment to cross just below the user's breast region.

* * * * *